United States Patent [19]

Zodrow

[11] 4,380,487

[45] Apr. 19, 1983

[54] METHOD AND APPARATUS FOR CHANGING THE LABEL MAGAZINE BOXES OF LABELING MACHINES

[75] Inventor: Rudolf Zodrow, Dusseldorf, Fed. Rep. of Germany

[73] Assignee: Jagenberg Werke, Dusseldorf, Fed. Rep. of Germany

[21] Appl. No.: 227,551

[22] Filed: Jan. 22, 1981

[30] Foreign Application Priority Data

Jan. 23, 1980 [DE] Fed. Rep. of Germany ..... 3002250

[51] Int. Cl.[3] ..... B65C 9/10; B65C 9/16

[52] U.S. Cl. ..... 156/568; 156/565; 156/571; 156/DIG. 29; 221/106; 271/9; 271/33; 271/158

[58] Field of Search ..... 156/565, 567, 568, 570, 156/571, DIG. 29, 573, DIG. 32; 271/9, 33, 158, 159, 3.1; 221/104, 105, 106

[56] References Cited

U.S. PATENT DOCUMENTS 1,976,892 10/1934 Shomaker ..... 271/9
3,358,991 12/1967 Jensen et al. ..... 156/DIG. 29
3,556,316 1/1971 Marasso et al. ..... 221/106
3,567,559 3/1971 Dullinger ..... 156/571
3,698,601 10/1972 Sierk et al. ..... 221/105
3,929,326 12/1975 Seragnoli ..... 271/9

*Primary Examiner*—Michael G. Wityshyn
*Attorney, Agent, or Firm*—Sprung, Horn, Kramer & Woods

[57] ABSTRACT

In the labeling of articles such as bottles by feeding the articles to a labelling machine having label pickup means, picking up labels from a label box, successively applying such labels to the articles, and periodically replacing the label box when empty with a full label box, the improvement which comprises replacing the empty label box during the time interval between successive label pickups without stopping the machine. An apparatus therefor includes two label boxes disposed alongside one another, guide means for the boxes so as to permit them to move together transversely to the direction in which labels are stacked in the boxes, and means permitting retracting and advancing in label stacking direction of that label box which is in active position.

9 Claims, 11 Drawing Figures

METHOD AND APPARATUS FOR CHANGING THE LABEL MAGAZINE BOXES OF LABELING MACHINES

BACKGROUND OF THE INVENTION

The invention relates to a method and an apparatus for changing the label magazine boxes of labeling machines.

In modern labeling machines, the labels to be affixed to containers, and in particular to bottles, are individually and successively picked up by gluing segments and then transferred to a gripper cylinder which in turn transfers the label that has been coated with glue while on the gluing segment to the container to be labeled.

Since in high-speed labeling machines the label box is emptied in about five minutes, there is the problem of refilling the magazine box with labels. The label magazine boxes can be refilled by hand only with difficulty since usually a number of magazine boxes are disposed one on top of the other at the pickup point. The lowermost box contains the belly label, and the one above it the breast label; and above that two further boxes may be disposed, one for the neck label and one for the foil to be wrapped around the top of the bottle. This is why the boxes are accessible practically only from the rear for the purpose of refilling.

There have been many proposals for automating the refilling of label boxes. For example, German patent application DOS 21 16 912 describes a refilling apparatus of this type in which the labels are pushed by means of a plunger from supply boxes disposed on a turntable into the label box which is in the pickup position. Since the labels must be pushed up in the label box continuously, even during the refilling operation, at the rate at which they are picked up, the transfer of the stack of labels pushed by the plunger into the label box to that conveying means is rather complicated and still requires semimanual operation.

Pickup of the labels poses still another problem that is a factor in the refilling of the label boxes. To avoid malfunctioning of the labeling machine, the label box located in the pickup position is always retracted from the pickup means when there is no container at the labeling point. This retracting of the label box is triggered by sensors located at the conveying path of the containers to be labeled. To permit this retracting of the label box, sufficient space must be provided, and the mass to be moved in retracting the label box must not be excessive. This is not necessarily the case with prior-art refilling apparatuses of the type disclosed in the aforesaid German patent application DOS 21 16 912. Besides, there the retracting movement of the label box would conflict with the advancing movement in refilling the label box, that is to say, the label box could not be retracted during refilling, or then only with great difficulty.

SUMMARY OF THE INVENTION

The present invention has as its object to provide an apparatus for changing the label magazine boxes of labeling machines which provides assurance that there will always be labels in the label box at the pickup point, that the label box can readily be retracted from the pickup means and there is nothing to impede that movement, and that manual handling is required only at considerable intervals of time so that one operator is able to attend several labeling machines.

To accomplish this object, a method and an apparatus having the characteristics set forth in the claims is proposed. "Label box", as used herein, should be construed to mean also a stack of two or more superposed label boxes from which the pickup means is able to pick up a plurality of labels (belly, breast and neck labels as well as foil) simultaneously.

The essential characteristic of the invention resides in the movement of a filled label box to the pickup point as the emptied label box is being removed in the same direction, this change being effected with such speed that it is completed in the interval of time in which two successive pickup means reach the pickup point. When this poses a problem with high-speed machines, the machine can momentarily be slowed down to a lower throughput rate during the label-box change to allow sufficient time for it.

The apparatus in accordance with the invention may be equipped with two or more label boxes. When there are only two label boxes which are alternately moved back and forth at the pickup point, the box which is not at the pickup point is refilled with labels. The refilling frequency can be decreased by locating a plurality of label boxes side by side on a guide.

The apparatus in accordance with the invention offers the following advantages:

- The mobility of the label box which is in the pickup position is not impeded by large masses of additional refilling means as it is retracted from the pickup means.
- The throughput of the machine is not reduced by the label-box change.
- The refilling frequency can be decreased by providing a plurality of label boxes.
- The apparatus is of relatively simple and space-saving construction.

BRIEF DESCRIPTION OF THE DRAWINGS

Further details of the apparatus in accordance with the invention will now be described with reference to the embodiments illustrated in the accompanying drawings, wherein.

DETAILED DESCRIPTION OF THE INVENTION

Figure 1:
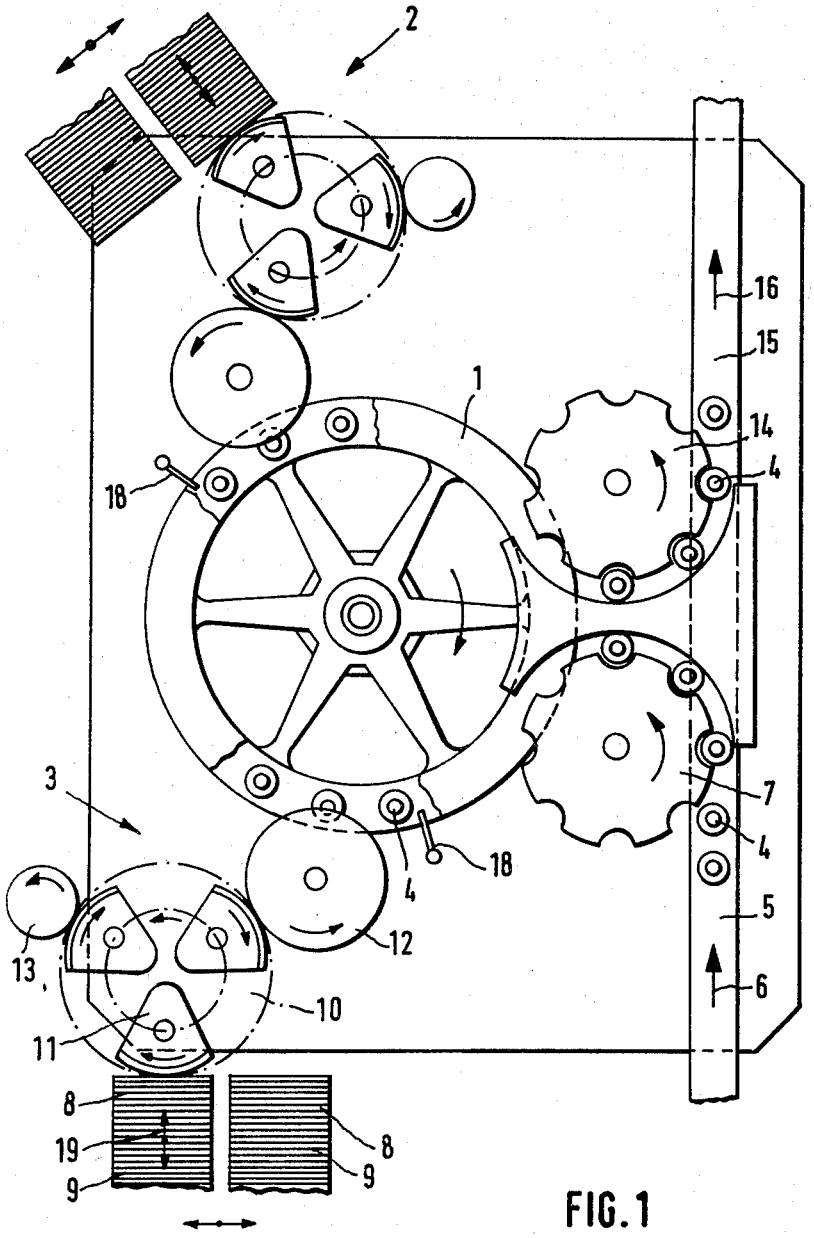
FIG. 1 is a top plan view of a labeling machine.

The labeling machine shown diagrammatically in FIG. 1 comprises two labeling stations 2 and 3 disposed around the bottle turret 1. The bottles 4 to be labeled are fed to the labeling machine on a conveyor 5 in the direction of the arrow 6 and are fed by an infeed starwheel 7 individually and spaced apart to the bottle turret 1. The labels 8 are individually picked up from the label box 9 which is in the pickup position by gluing segments 11, which are pivotably mounted on a carrier 10, and transferred to a gripper cylinder 12 which places the labels on the bottles 4. A glue roll 13 applies to the segments 11 a layer of glue which during the pickup is transferred to the labels 8. The labeled bottles 4 are then routed by way of an outfeed starwheel 14 to a discharge conveyor 15 and are discharged from the labeling machine in the direction of the arrow 16.

Next to the label box 9 which is in the pickup position there is a further label box 9, filled with labels 8, in the waiting position. It is moved to the left in the direction of the arrow 17 as soon as the label box 9 which is in the pick-up position is empty. After the change of label boxes 9, the empty box is refilled and then moved to the right in the direction of the arrow 17 as soon as the other box 9 is empty.

When the sensor 18 indicates that a bottle is missing on the bottle turret 1, the label box 9 which is in the pickup position is retracted from the gluing segment 11 in the direction of the arrow 19 and advanced toward the gluing segment only when the sensor 18 detects the presence of a bottle 4 on the bottle turret 1.

Figure 2:
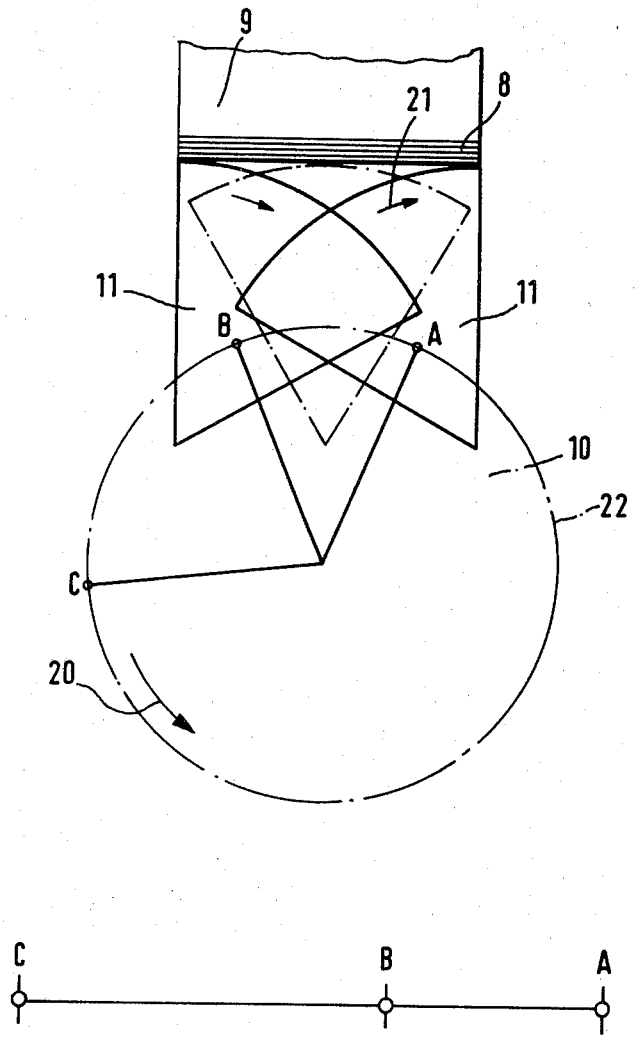
FIG. 2 illustrates the cycle of motions of gluing segments disposed on a revolvable turret which serve as pickup means at the pickup point.

FIG. 2 shows the length of time which is available for a change of label boxes 9. Gluing segments 11 are pivotably mounted on a carrier 10 which revolves in the direction of the arrow 20. At the start of pickup the gluing segment 11 which picks up the label first makes contact by its right-hand edge with the label 8 which is in the pickup position and then, in its pivoting motion, rolls along the label 8 in the direction of the arrow 21 and in so doing picks it up from the label box 9. In the position of the gluing segment 11 shown on the left, the gluing segment lifts off the label box 9 along with the label 8 picked up by it. This pickup time interval corresponds to the distance between the points A and B on the pitch circle 22 drawn through the pivots of the gluing segments 11. The interval of time available for the change of label boxes 9, in other words, the length of time between the instant that a gluing segment lifts off and the start of pickup by the next gluing segment 11 corresponds to the distance between the points B and C on the pitch circle 22. These path and time segments are further represented in FIG. 2 as a straight line.

Figure 3:
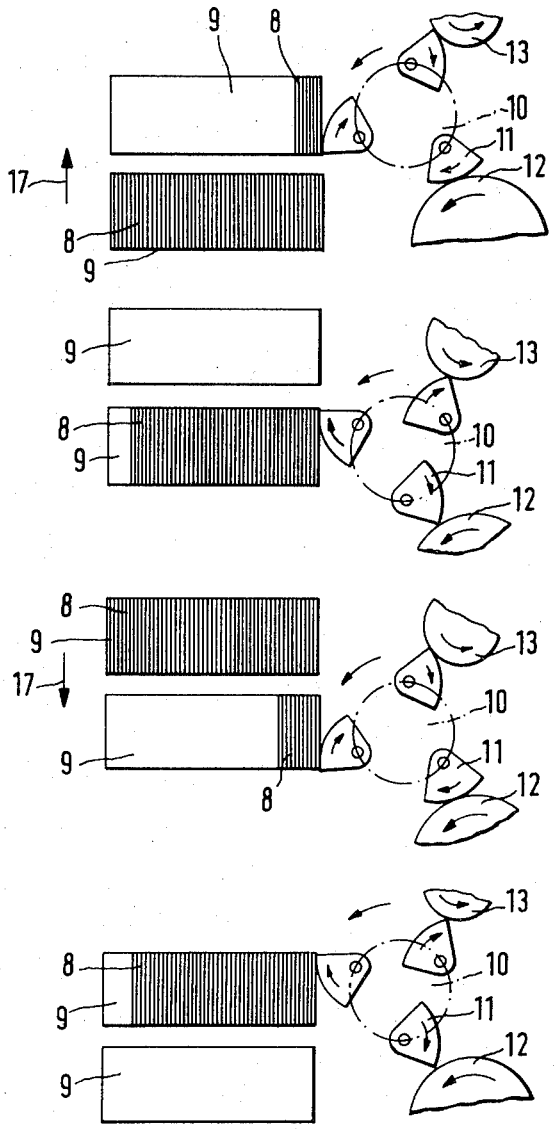
FIG. 3 shows the alternating positions of two label boxes at the pickup point.

FIG. 3 illustrates the change of two label boxes 9 arranged side by side. In the top figure, the upper label box 9 is at the pickup point. As soon as it has been emptied, the label box 9 located next to it in the waiting position and filled with labels 8 is moved into the pickup position in the direction of the arrow 17 and the empty box 9 is simultaneously moved out of the way. The top figure shows the position of the gluing segments 11 at the start of this label-box shifting. In the second figure, the label-box change must be completed in order that the next gluing segment 11 reaching the pickup position may be able to pick up a label properly from the label box 9 which has now been moved into the pickup position.

The third and fourth figures in FIG. 3 indicate the start and end of the next label-box change in the directions of the arrow 17 with the respective positions of the gluing segments 11 on the carrier 10.

Figure 4:
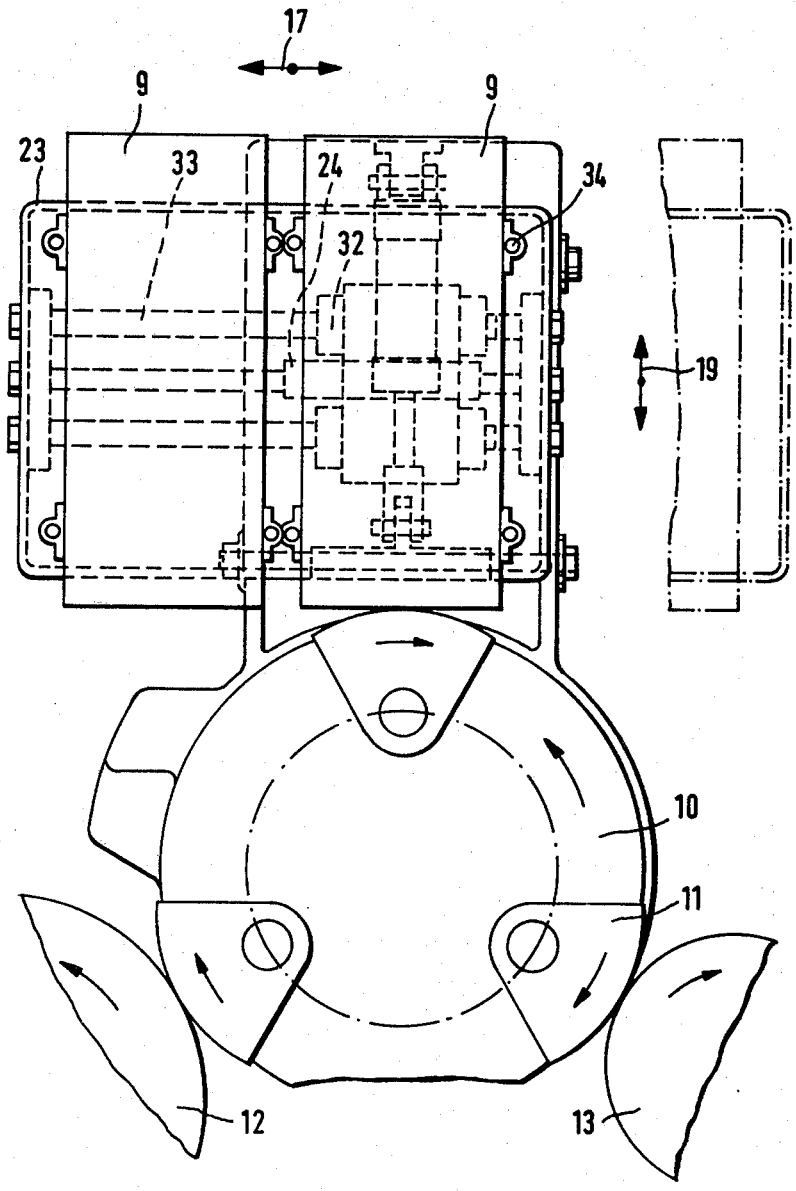
FIG. 4 is a top plan view showing the structural layout when two label boxes are provided side by side.
Figure 5:
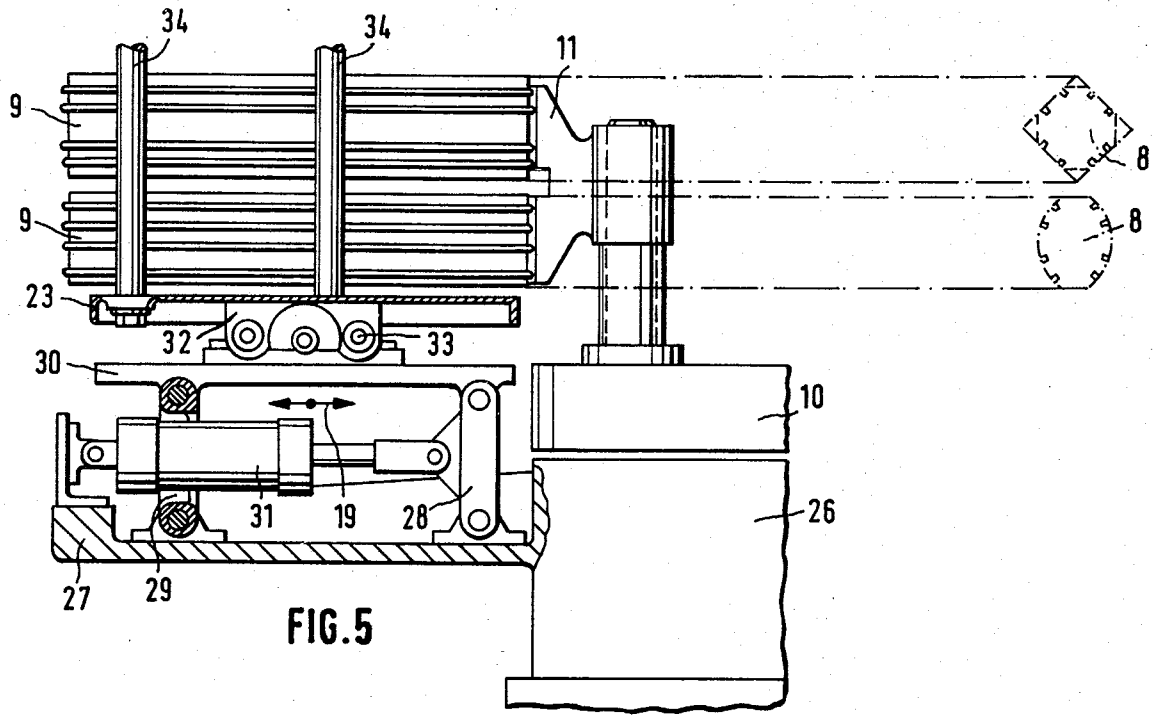
FIG. 5 is a side elevation of the structure of FIG. 4.

FIGS. 4 and 5 illustrate an embodiment of the apparatus in accordance with the invention which comprises two label boxes 9 that are disposed on a common supporting frame 23, are adapted to be moved back and forth in the directions of the arrow 17, and are alternately moved into the pickup position. The supporting frame 23 is structurally joined to the supporting structure of the gluing segment 11. The label boxes 9 are indicated by solid lines in one end position and by broken lines in the other end position.

The transverse movement of the label boxes 9 in the directions of the arrow 17 is actuated by a drive 24 which is secured on the one hand to the supporting frame 23 and on the other hand to a parallelogram lever arrangement 28, 29 and 30 (FIG. 5).

Pivoted to a plate 27 mounted on the supporting structure 26 of the carrier 10 are two levers 28 and 29 whose free ends are pivotably secured to a support plate 30. A drive 31 is secured at one end to the plate 27 and at the other end to the lever 28. When the drive 31 is actuated, the parallelogram lever arrangement 28, 29 and 30, and with it the label boxes 9, are advanced or retracted in the directions of the arrow 19.

Mounted on the plate 30 are guides 32 through which guide rods 33 joined to the supporting frame 23 for the label boxes 9 are adapted to slide. When the drive 24 is actuated, the supporting frame 23 can thus be displaced in the directions of the arrow 17 by means of the guide rods 33 passing through the guides 32 on the plate 30. The supporting frame 23 for the label boxes 9 is entrained in the advancing and retracting movements of the parallelogram lever arrangement 28 to 30 in the directions of the arrow 19 since the guides 32 are fixed to the plate 30.

The label boxes 9 are held loosely and accurately positioned by guide bars 34 fastened to the supporting frame 23 for entrainment as the supporting frame 23 moves in a direction indicated by the arrow 17 or 19.

In FIG. 5 the gluing segment 11 which picks up labels 8, such as a belly label and a breast label, from the front opening of the stacked label boxes 9 is apparent.

Figure 6:
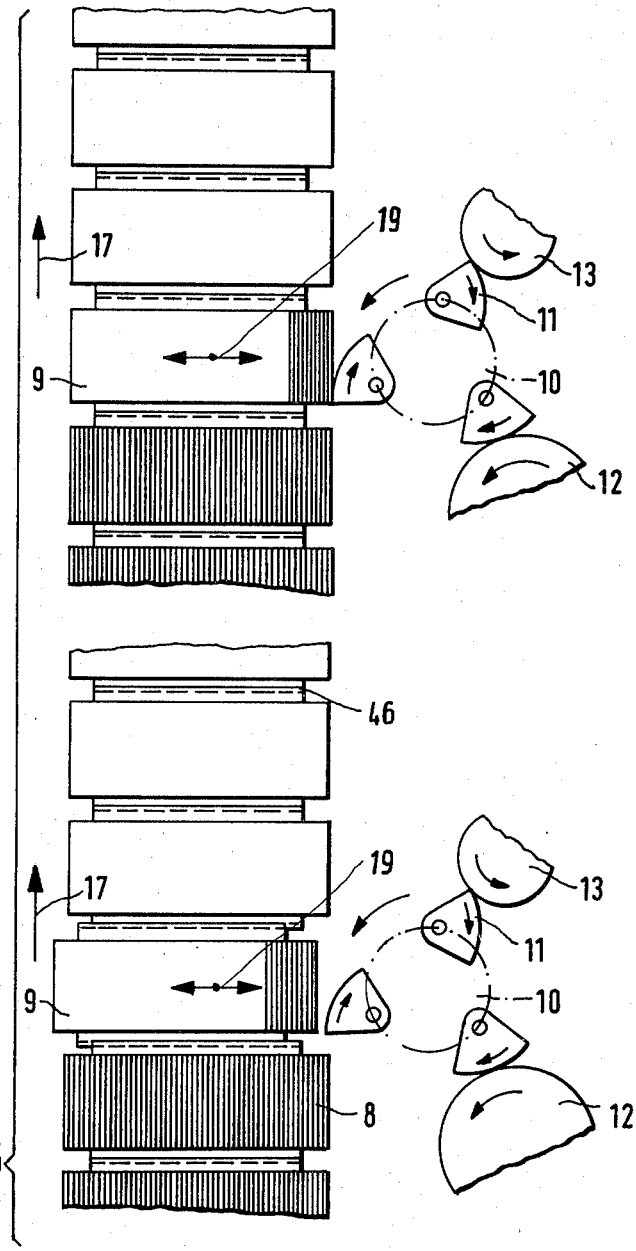
FIG. 6 is a diagrammatic view of the apparatus with a plurality of label boxes disposed on a guide track.

Shown diagrammatically in FIG. 6 is an apparatus in accordance with the invention which comprises a plurality of label boxes 9 that are to be successively moved up to the pickup point in the direction of the arrow 17, the particular label box 9 which is in the pickup position being adapted to be advanced to and retracted from the gluing segment 11 in the directions of the arrow 19. The lower portion of FIG. 6 shows the box 9 in the position in which it is retracted from the gluing segment 11.

Exemplified embodiments of the guide for the transverse movement of a plurality of label boxes 9 arranged side by side are shown in FIGS. 7 to 11.

Figure 8:
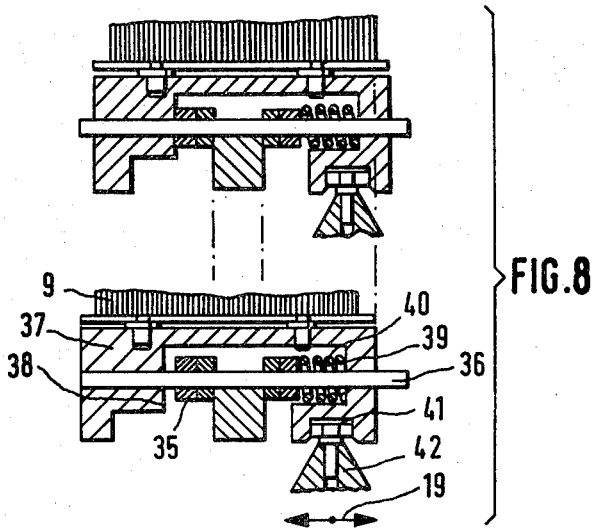
FIG. 8 is a cross-sectional view of the apparatus of FIG. 7.
Figure 7:
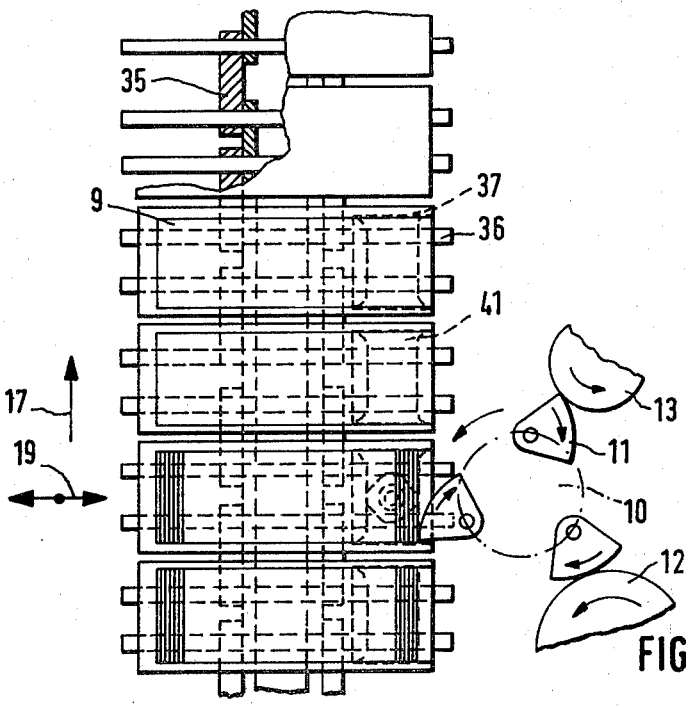
FIG. 7 is a top plan view of an embodiment of the apparatus in accordance with the invention with a plurality of label boxes arranged side by side.

In the arrangement shown in FIGS. 7 and 8, the guide track for the label boxes 9 is formed by a chain 35. Seated on extended ends of the chain-link pins 36 of the chain 35 are carriers 37 on which the label boxes can be placed, accurately positioned by means of pins.

Lateral guidance of the carriers 37 on the chain 35 is secured in that the carrier 37 abuts by an interior surface 38 on one side of the chain and is held thereagainst through a compression spring 40 disposed between the other side of the chain 35 and the opposite interior surface 39 of the carrier 37.

On the underside of the carrier 37 there is formed a guide recess 41 which is engaged by an entrainment member 42 disposed at the pickup point. Said entrainment member 42 is displaceable in the directions of the arrow 19 through a drive which is not shown and during such displacement entrains the label box 9 which is in the pickup position.

For their conjoint transverse movement in the direction of the arrow 17, the label boxes 9 arranged side by side on the guide track formed, for example, by the chain 35 may, as indicated in FIG. 7, abut on one another by their adjacent sides or, as shown in FIG. 6, be spaced apart by extensions 46. However, as is apparent from FIGS. 9 to 11, it is also possible to provide a loose connection between adjacent label boxes 9 through dovetailed joints 43, for example, on the side walls of the label boxes 9.

Figure 10:
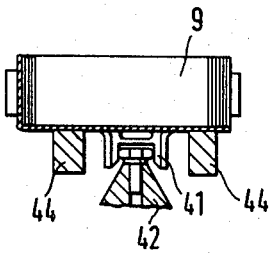
FIG. 10 is a cross-sectional view of the apparatus of FIG. 9.
Figure 11:
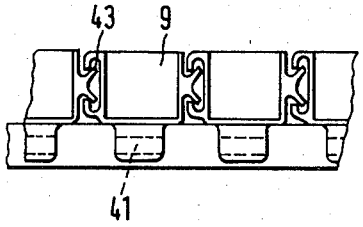
FIG. 11 is a partial front elevation of the apparatus of FIG. 9.
Figure 9:
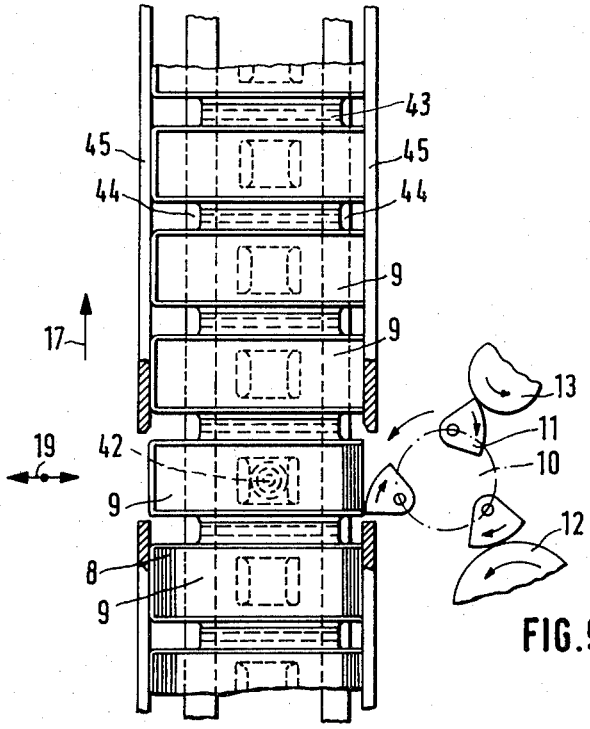
FIG. 9 is a top plan view of a further embodiment.

In the embodiment illustrated in FIGS. 9 to 11, the guide track is formed by two rails 44 on which the label boxes 9, laterally guided by guide rails 45, can be conjointly moved transversely in the direction of the arrow 17. In proximity to the pickup point the guide rails 45 are interrupted to permit the label box 9 which is in the pickup position to be retracted and advanced in the directions of the arrow 19 by the entrainment member 42 engaging the bottom recess 41. Lateral guidance of the label box 9 which is in the pickup position is provided on the rails 44, as viewed in the direction of transverse motion indicated by the arrow 17, by the entrainment member 42 which engages the bottom recess 41.

As soon as the label box 9 which is in the pickup position is empty, which may be determined by appropriate sensing means, the drive for the transverse movement of the label boxes 9 is started to move the next label box 9 filled with labels 8 into the pickup position, with the label box 9 just emptied then automatically moving on.

The empty boxes 9 can be refilled with labels on the guide track or at some other point, and the filled label boxes 9 are then set onto the other end of the guide track. However, depending on the length of the feed track, a whole row of filled label boxes 9 may be put in place. In this way the refilling frequency may be decreased so that an operator is not kept busy refilling label boxes with labels at the machine.

The embodiments illustrated may be modified in numerous ways. For example, more than two label boxes arranged side by side as shown in FIGS. 4 and 5 may be combined to form a structural unit adapted to be moved back and forth at the pickup point. The design of the guide track and the mode of setting the boxes upon it may also be modified in many different ways. Such modifications are likewise intended to be protected, provided that they embody the idea underlying the invention.

It will be appreciated that the instant specification and examples are set forth by way of illustration and not limitation, and that various modifications and changes may be made without departing from the spirit and scope of the present invention.

I claim:

1. In a labelling machine having means for feeding articles to be labelled, a label supply, label pick up means for picking up a label from the supply, means for applying the the machine, and means for replacing the label supply when exhausted, the improvement wherein said label supply comprises at least three label boxes disposed alongside one another at the pickup point so as to be successively displaceable in one direction, the label boxes being releasably joined to one another by a dovetailed joint formed along their side walls, and the means for replacing the label supply when exhausted comprises guide means for the boxes so as to permit them to move together transversely to the direction in which labels are stacked in the boxes, and means permitting retracting and advancing in label stacking direction of that label box which is in active position.

2. An apparatus according to claim 1, including first drive means for moving the boxes together transversely to the label stacking direction, the means permitting retracting and advancing including second drive means.

3. An apparatus according to claim 2, wherein the label boxes are arranged so as to be displaceable on a supporting structure joined to that of the pickup means.

4. An apparatus according to claim 2, including a supporting frame for the boxes, and guide rods on the frame, the boxes being capable of individual placement upon the guide rods.

5. An apparatus according to claim 1, wherein all the label boxes, except the one which is in the pickup position, are guided by guide rails disposed along a guide track.

6. An apparatus according to claim 1, wherein the label boxes or the means supporting them are provided on their bottom or rear wall with a guide for an entrainment means disposed at the pickup point for the retracting and advancing motion of the label box which is in the pickup position.

7. An apparatus according to claim 16, wherein for transverse movement an endless chain is provided with extended hinge pins carrying supporting means for the label boxes.

8. An apparatus according to claim 8, wherein the supporting means are guided by a compression spring set onto a section of the extension of the chain hinge pin, said spring abutting at one end against one of the sides of the chain links and at the other end against an interior wall of the supporting means whose opposite interior wall is caused to abut on the other side of the chain links by the action of the compression spring.

9. An apparatus according to claim 7, wherein the label boxes are adapted to be set into the supporting means accurately positioned by means of pins.

* * * * *

UNITED STATES PATENT AND TRADEMARK OFFICE

CERTIFICATE OF CORRECTION

PATENT NO. : 4,380,487

DATED : April 19, 1983

INVENTOR(S) : Rudolf Zodrow

It is certified that error appears in the above-identified patent and that said Letters Patent is hereby corrected as shown below:

| | |
|---|---|
| Col. 6, line 8 | After first "the" insert omitted words --label to the article, means for removing labelled articles from-- |
| Col. 6, line 46 | After "according to" delete "claim 8" and insert --claim 7-- |

Signed and Sealed this

*Twenty-eighth* Day of *June 1983*

[SEAL]

*Attest:*

GERALD J. MOSSINGHOFF

*Attesting Officer*

*Commissioner of Patents and Trademarks*